United States Patent [19]

Norman

[11] Patent Number: 4,699,703

[45] Date of Patent: Oct. 13, 1987

[54] ANODIC BOOT FOR STEEL REINFORCED CONCRETE STRUCTURES

[75] Inventor: George R. Norman, Aurora, Ohio

[73] Assignee: Lauren Manufacturing Company, New Philadephia, Ohio

[21] Appl. No.: 859,073

[22] Filed: May 2, 1986

[51] Int. Cl.[4] ..... C23F 13/00

[52] U.S. Cl. ..... 204/196; 204/286; 204/288; 204/289; 204/297 R

[58] Field of Search ..... 204/147, 148, 196, 197, 204/286, 297 R, 284, 288, 289

[56] References Cited

U.S. PATENT DOCUMENTS

| | | | |
|---|---|---|---|
| 1,489,743 | 4/1924 | Delius et al. | 204/196 |
| 2,847,375 | 8/1958 | Murphy | 204/196 |
| 3,047,478 | 7/1962 | Marsh et al. | 204/197 |
| 3,208,926 | 9/1965 | Eckfeldt | 204/409 |
| 3,553,094 | 1/1971 | Scott et al. | 204/197 |
| 3,925,185 | 12/1975 | Lint | 204/252 |
| 3,992,272 | 11/1976 | Maxson et al. | 204/147 |
| 3,994,794 | 11/1976 | Bohne | 204/197 |
| 4,198,280 | 4/1980 | Swartz | 204/415 |
| 4,227,985 | 10/1980 | Morgan | 204/196 |
| 4,502,929 | 3/1985 | Stewart et al. | 204/280 |
| 4,506,485 | 3/1985 | Apostolos | 52/515 |

FOREIGN PATENT DOCUMENTS 2140456A 11/1984 United Kingdom .

*Primary Examiner*—T. Tung

*Attorney, Agent, or Firm*—Renner, Kenner, Greive, Bobak & Taylor

[57] ABSTRACT

An anodic boot for the protection of steel reinforcement in concrete support structure from corrosion. The boot includes flexible panel means having first and second sides, at least one side of which is conductive polymer, and means for affixing the ends of the panel means about the circumference of the concrete support structure, maintaining the first side in contact with the exterior surface of the concrete support structure. By connecting the reinforcing bars to the negative side of a D.C. source and placing the positive side into the water surrounding the concrete support, a cathodic reaction occurs.

10 Claims, 6 Drawing Figures

ANODIC BOOT FOR STEEL REINFORCED CONCRETE STRUCTURES

TECHNICAL FIELD

The present invention is directed toward an polymeric sheath or boot that has been made conductive and is affixed to concrete support structures for bridges standing in marine environments, particularly the ocean. Corrosion of reinforcing steel in concrete that is exposed to environments containing high concentrations of chloride ion is a major problem throughout the world but particularly in coastal areas. In the state of Florida, for instance, there are about 7000 bridges passing over a body of ocean water. The action of the tide and of the waves bathes the surface immediately above the water line wetting the concrete and embedded reinforcing bars.

After myriad studies of the problem, one of the most effective methods for controlling corrosion of the steel reinforcement is electrolytically, such as cathodic protection. This method impresses a direct current voltage between the reinforcing steel as the cathode and the environment, sea water, as the anode. The sheath or boot set forth herein provides good current distribution over the areas of the concrete bridge pilings to be protected.

BACKGROUD ART

The use of an anode to protect steel standing in ocean water was described in an early U.S. Pat. No. 1,489,743 which teaches placement of an anode in close proximity to the steel pile and placement of the cathode in the water. As current is passed through the circuit formed, chlorine is generated at the anode which destroys marine growth that can be detrimental to the pile. This patent does not disclose protection from corrosion.

U.S. Pat. No. 3,992,272 discloses a method of protecting submerged steel support members utilized for offshore drilling platforms. The method is practiced by coating the joints with concrete containing polymeric latex and polymeric reinforcement and then placing cathodic protection on the support. The coating acts as a sacrificial anode to provide cathodic protection to the steel or alternatively, the protection can be derived from an impressed current.

U.S. Pat. No. 4,227,985 provides an anode assembly for the protection of submerged ferrous members, such as piles of a pier or offshore oil rig, which assembly includes two or more fiberglass panels fixed together to encircle the member. These panels provide at least two anodes electrically connected together. An electric current is carried to the anode where it passes into the water, providing cathodic protection.

U.K. application No. 2,140,456A discloses a method for cathodically protecting steel reinforcement in concrete by connecting the steel to a cathodic protection system that employs an electrically conductive film, applied to the concrete surface, as the anode.

While there have been many applications of cathodic protection heretofore, not all have been applicable directly to the concrete structure to protect the steel reinforcement embedded therein. Moreover, as to those that are employed in this manner, they have suffered from application or durability considerations and have not provided satisfactory protection.

SUMMARY OF THE INVENTION

It is therefore an object of the present invention to provide a novel anodic boot to be fastened to concrete support structures for bridges, piers and the like which protects the steel reinforcement embedded therein cathodically.

It is another object of the present invention to provide a novel anodic boot that is readily fastenable to concrete support structures standing in water.

It is still another object of the present invention to provide a novel anodic boot that is durable and not effected by the environment including tidal and wave action and is essentially resistant to vandalism.

It is yet another object of the present invention to provide a novel anodic boot comprising a conductive polymer.

It is a further object of the present invention to provide an anodic boot in a standard panel configuration including means to affix several panels together to accommodate concrete structures of various sizes.

These and other objects and advantages of the present invention shall become apparent from the specification which follows.

In general, the present invention is directed toward an anodic boot for the protection of steel reinforcement in concrete support structures from corrosion which comprises flexible panel means having first and second sides, at least one side of which is conductive polymer, and means for affixing the ends of the panel means about the circumference of the concrete support structure, maintaining the first side in contact with the exterior surface of the concrete support structure.

PREFERRED EMBODIMENT FOR CARRYING OUT THE INVENTION

Figure 1:
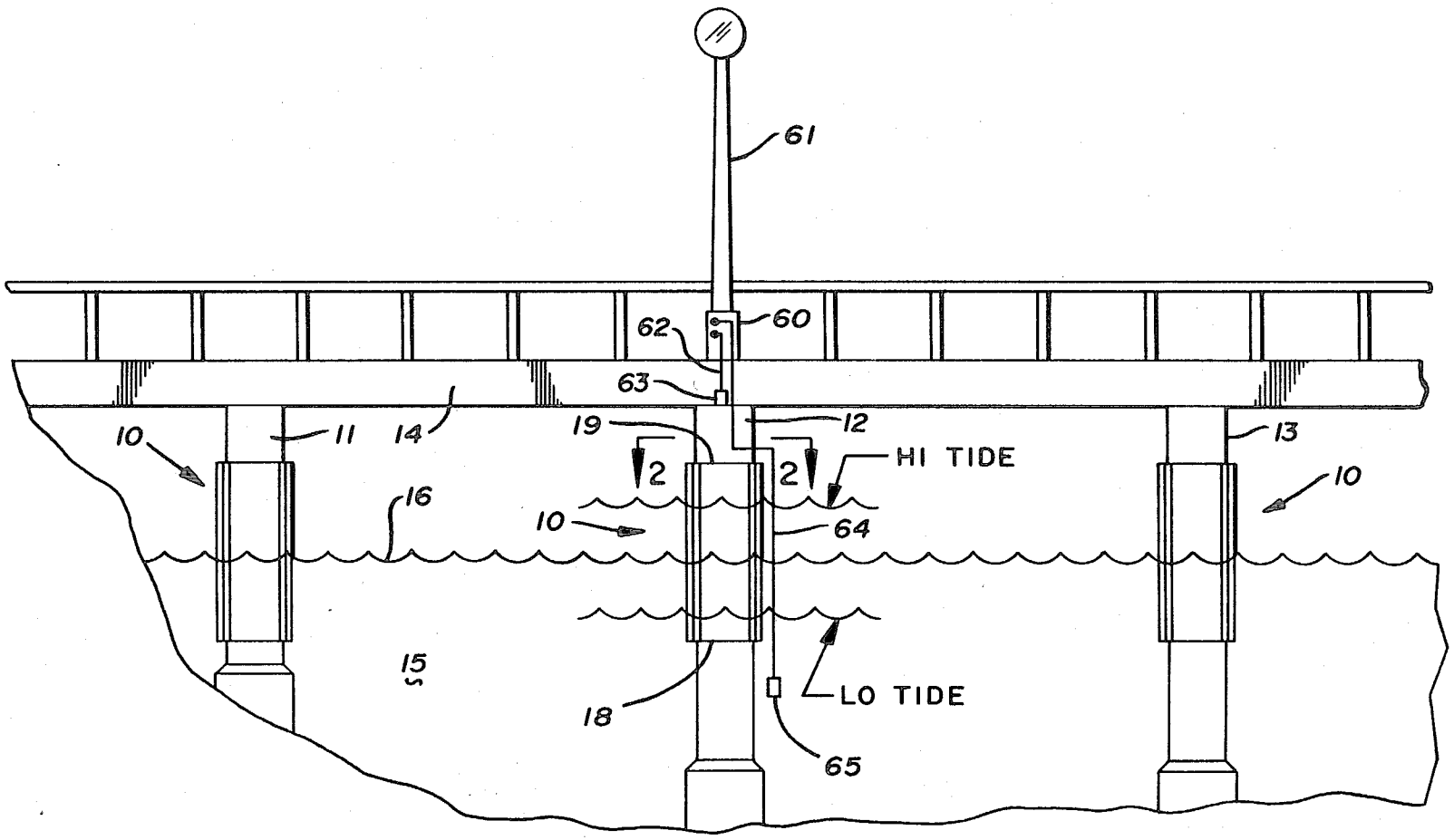
FIG. 1 is an elevational view of a bridge over a body of water depicting the anodic boot of the present invention in place around the concrete support structures.

The anodic boot of the present invention is depicted generally by the numeral 10 in the drawings. In FIG. 1, a boot 10 is depicted in place on each of three concrete support structures or columns 11, 12 and 13 from a bridge 14. The supports are shown in a body of sea water 15 having a waterline 16 that moves between tidal positions as seen in the drawing. The boot 10 is of sufficient height that it extends below low tide levels as well as above high tide levels plus an allowance at high tide to accommodate the splashing action of waves. The dimension of the boot will vary with the location in which it is employed but it should be of sufficient size and positioned in such a manner that the waterline 16 does not extend below the lower end 18 or above the upper end 19 thereof.

Inasmuch as the concrete supports are each alike, the center column 12 and boot 10 shall be described in full detail, it being understood that the use of the boot 10 will be the same as with supports 11 and 13 and other supports in general. The boot 10 comprises two elements: a generally wide flat panel indicated by the numeral 20, and fastening means 21 for affixing the ends of the panel 20 or panels together around the concrete support 12.

Figure 5:
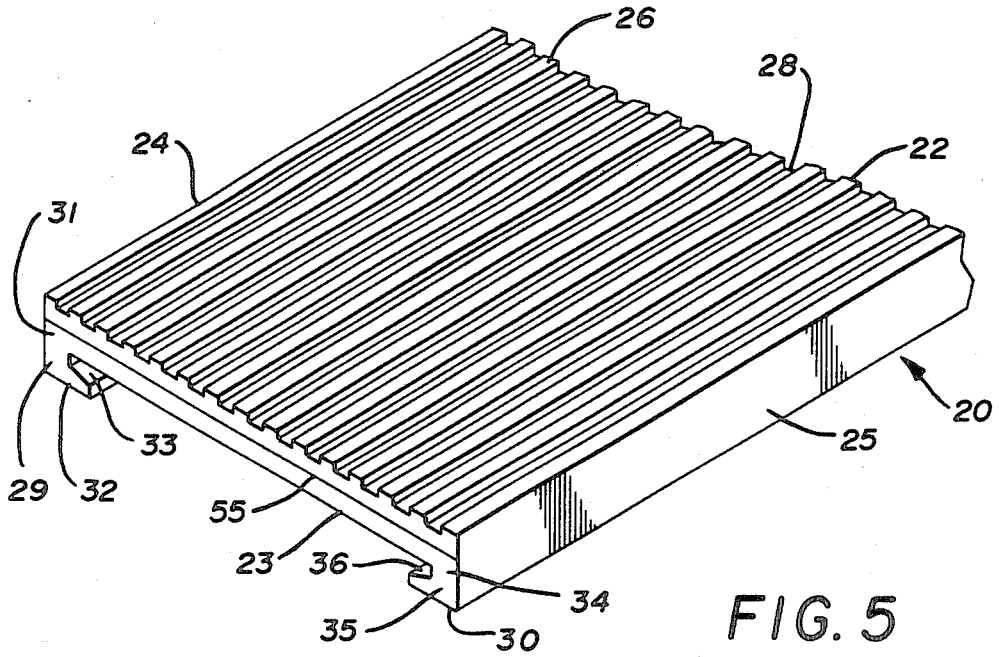
FIG. 5 is a perspective view of a flat panel component of the anodic boot.
Figure 6:
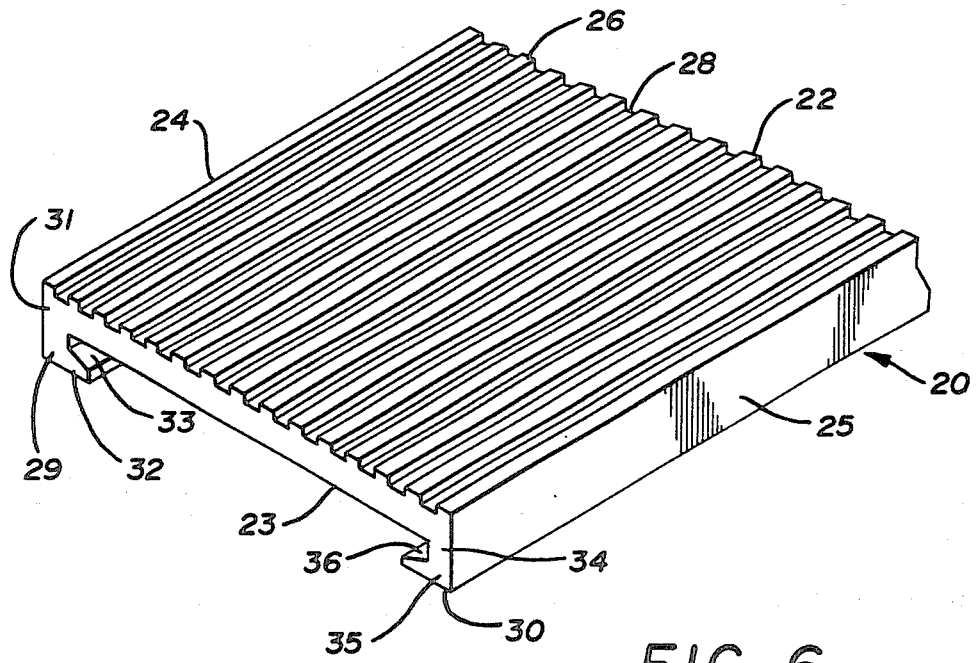
FIG. 6 is a perspective view of an alternative flat panel component of the anodic boot.

With reference to FIGS. 5 and 6, the panel 20 has a first side 22 and a second side 23 and left and right side walls 24 and 25, respectively. The first side carries a plurality of projections 26 which can be in the form of longitudinally extending ribs separated by passageways or channels 28. As seen in the drawings, the depth and width of the channels are approximately equal to the height and width of the ribs. The ribs 26 are not particularly large, a height and width of approximately one-sixteenth inch (1.5 mm) being typical.

The side walls 24 and 25 and second side of panel 20 join together to form left and right flanges 29 and 30. The left flange includes a vertical leg 31 which terminates in an inwardly directed foot 32, the upper side of which bears a ramp 33. Similarly, the right flange 30 includes a leg 34, inwardly directed foot 35 and ramp 36.

Figure 4:
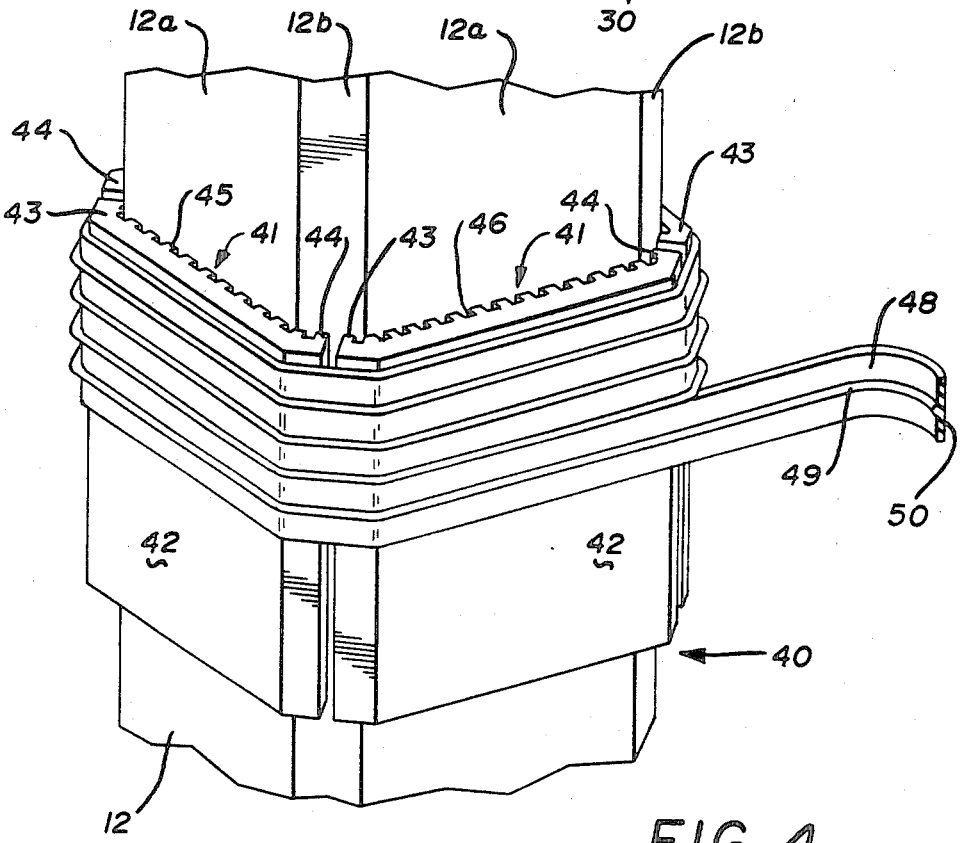
FIG. 4 is a perspective view depicting an alternative form of anodic means and means for fastening around the concrete support structure.

The second side 23 of panel 20 provides a broad, essentially flat face and the panels 20 have a flexibility allowing them to conform to the shape of the concrete structure, as is shown in the drawings. The column 12, depicted in FIG. 4 is square with bevelled corners providing eight flat surfaces of two different sizes, 12*a* and 12*b*. Four panels have been employed to encircle the column 12 and the left and right ends of adjacent panels 20 terminate on the surface 12*b*. The ribs 26 of the first side 22 are positioned against surfaces 12*a* and 12*b* while the second side 23 is exposed.

Figure 2:
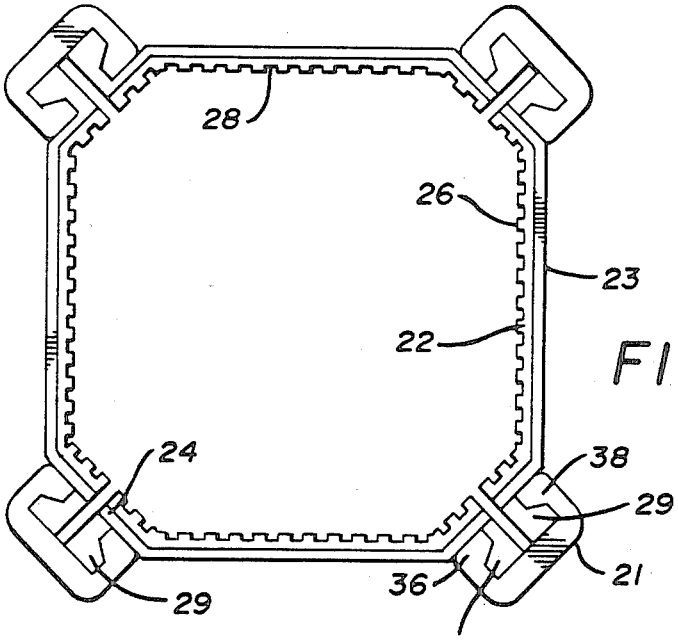
FIG. 2 is a top plan view, taken substantially along the lines 2—2 of FIG. 1 of the anodic boot.
Figure 3:
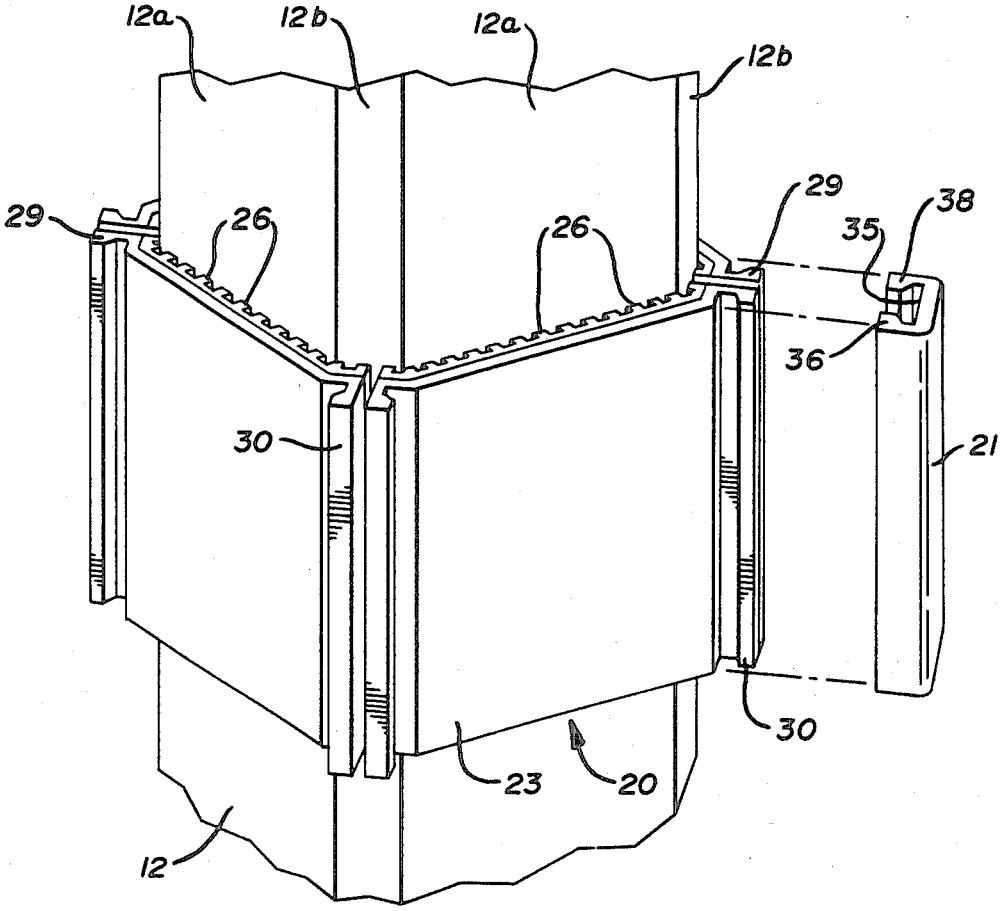
FIG. 3 is a perspective view depicting one form of anodic boot and its means for fastening around the concrete support structure.

In order to affix the panels 20 forming the boot to the column 12, mechanical fasteners 21 are employed. These have an internal open channel 35 formed by continuous inwardly directed edges 36 and 38. As is seen in FIGS. 2 and 3, the channel 35 matingly engages adjacent flanges 29 and 30 of adjacent panels 20. The fastener is preferably a rigid yet flexible polymer that can be snapped over the flanges 29 and 30. Alternatively, a stiffer material including metal can be employed and slid down over the top of the flanges 29 and 30. During installation, it is preferred that the flanges 29 and 30 be pulled together or slightly stretched so that the components of the boot will remain in tension, thereby resisting slippage in response to contraction and expansion of the boot and column.

Another form of boot is depicted in FIG. 4 wherein the panels, designated by the numeral 40, have first and second sides 41 and 42, and left and right side walls, 43 and 44. The first side 41 again carries projections or ribs 45 and passageways or channels 46. The panels 40 do not carry the flanges 29 and 30 provided on panel 20 and thus a different means of fastening is also provided. In order to affix the panels 40 together around the column 12, a rubber strip 48 is employed as the fastening means.

A rubber or comparable polymer material may be somewhat preferred because it can be stretched during application and will also remain tight as the column and boot expand and contract. The strip 48 can be reinforced with cords of metal or synthetic fibers, or one or more external ribs 49, or be unreinforced. In either instance, it should be of sufficient thickness and tensile strength to resist the actions of vandalism with sharp instruments or minor engagements with passing marine craft. The strip 48 is most suitably affixed to the panels 40 with an adhesive which can be applied at the time of installation to one or both surfaces of the strip 40 and second side 42 or the strip can be manufactured with a layer of pressure sensitive adhesive affixed to its underside 50.

When the boot 10 is mounted on the column, the ribs or projections maintain the first side from total engagement with the surfaces 12*a* and 12*b*. This allows water to pass freely between the column 12 and boot 10, thereby washing away any deposits such as salts that may form as a result of electrolytic reactions or evaporation.

It should be understood that while four panels 20 or 40 have been depicted to encircle the column 12, the present invention is not so limited. Thus, for example, a single panel of sufficient width could be wrapped around the column and its left and right ends joined together. Or two panels could be employed, each covering one-half of the column. As a further alternative, two narrow panels could be employed over one side 12*a* in side-to-side fashion, for a total of more than four to encircle the column. Clearly, the ability to mount the panels in this manner, facilitates the installation on columns of various shapes, e.g., circular, square, rectangular as well as having different dimensions.

The panels 20 and 40 are each made of a polymeric material including plastics, organic and inorganic rubbers and thermoplastic elastomers and combinations thereof that have flexibility, good cut and abrasion resistance and optionally, some elasticity. Inasmuch as they are in constant exposure to the environment, it is preferable that they contain minimal unsaturation to guard against aging. Typical physical properties of an elastomer composition include a Shore A hardness of 90; tensile strength $=6.9$ MPa; elongation $=175\%$; compression set at 23° C. $=45\%$ and specific gravity $=1.08$. Suitable elastomeric polymers include ethylene-propylene-diene terpolymers or EPDM rubber, styrene-isoprene rubber, silicone rubber, neoprene and the like and blends thereof. The foregoing values are only typical and those skilled in the art will recognize a range over which the properties may be varied. The fasteners 21 and rubber strip 48 are preferably made of the same type of polymer as selected for the panels in order to provide durability and good aging properties.

In order for the boot to function as an anode, it must be conductive or at least have a conductive surface. As is known, conductivity can be imparted to a rubber or other polymeric material by incorporating electrically conductive materials such as graphite, carbon black, coke breeze and the like as fillers. The amount of conductive material added will depend somewhat on the resistivity it possesses. The resistivity of the boot 10 should be at least 0.5 ohm-cm up to about 10 ohm-cm. Addition of the conductive materials in amounts of from about 15 to 35 parts per hundred rubber or polymer (phr) should provide the necessary properties. It is to be understood that the present invention is not necessarily limited to one particular polymer and a specific conductive material, but rather to those conductive polymer compounds that have the physical characteristics discussed hereinabove.

One typical formulation for the manufacture of conductive panels has been set forth hereinbelow as Stock A. The polymer comprised a blend of EPDM and styrene-isoprene rubbers totalling 100 parts. All additives are present as phr.

| STOCK A | |
|---|---|
| EPDM | 80 |
| SIR[a] | 20 |
| Processing oil | 30 |
| Conductive Black | 50 |
| Processing aid[b] | 6 |
| Desiccant[c] | 4 |
| Peroxide curative[d] | 3 |

[a]styrene-isoprene rubber
[b]wax
[c]calcium oxide
[d]dicumyl peroxide

It is also possible for the boot to have a layered panel 20. With reference to FIG. 5, the first side 22 and second side 23 are separate and are joined together at 55 by a suitable adhesive. In this construction, the first side can be a conductive silicone rubber and the second side can be EPDM or other ozone resistant elastomeric material which need not be conductive. It should be appreciated that the boot 40 of FIG. 4 can also have a layered construction, although not shown. The advantage of this alternative is to provide a good conductive material in connection with the column 12 and a good abrasion resistant material, having good aging properties on the exterior. This is particularly advantageous for the panel 20 which is largely exposed whereas the panel 40 is otherwise covered by the strip 48.

As a further enhancement, all elastomer surfaces of the boot can be coated with a fluoroelastomer coating of about 1 to 10 mils (0.025 to 0.25 mm) thickness to impart greater imperviousness to the environment. A suitable coating composition is set forth in U.S. Pat. No. 4,323,603, the subject matter of which is incorporated herein by reference. It can be applied by spraying, painting or dipping the components prior to installation on the column.

Having thus described the structure of the anodic boot and its installation, the use thereof follows. First, a suitable D.C. source such as an AC-DC rectifier is necessary, as is designated in FIG. 1 at 60 from a light or other utility pole 61. The negative side (cathode) is connected by a wire 62 to one of the reinforcing bars 63 embedded in the column 12. The positive side (anode) is connected by a wire 64 to an electrode 65 that is placed in the water. In this manner, it will be understood that the water and boot 10 act as an anode, and the reinforcing bars act as the cathode. The anode 65 is preferably a conductive metal that is corrosion resistant and although its location in the water is only depicted schematically, a variety of suitable arrangements may readily be employed to avoid disturbances. As one example, the wire 64 could be connected to a conductive metal pipe that is submerged in the water in proximity to the column 12.

Potentials of between about 10 to 50 volts are normally available or can be and would be suitable for the cathodic reaction. It would be within the skill of the art to determine the proper voltage depending upon the reinforcing bars, the concrete thickness and conditions of the environment and to vary the voltage automatically as these change.

It should be evident from the foregoing description that the anodic boot of the present invention has utility in minimizing corrosion of reinforcing bars subject to marine environments. Moreover, the panel component of the boot can be readily extruded in various widths and continuous lengths from which desired segments can be cut. Thus, manufacture is relatively simple which is reflective in the overall cost to protect a bridge or similar structure. Installation is also facilitated and yet a structure is provided that is not readily susceptible to damage by the harsh salt-water environments or by humans or passing boats.

In conclusion, it should be clear from the foregoing specification disclosure that the anodic boot of the present invention exhibits improved properties as compared to conventional devices for protecting steel. It is to be understood that the selection of a conductive polymer is not limited to an EPDM or silicone rubber formulation containing graphite, carbon black and the like or by the disclosure of typical rubber polymers and conductive materials provided herein, which may be readily selected by those skilled in the art.

Thus, it is believed that any of the variables disclosed herein can readily be determined and controlled without departing from the scope of the invention herein disclosed and described. Moreover, the scope of the invention shall include all modifications and variations that fall within the scope of the attached claims.

I claim:

1. An anodic boot for the protection of steel reinforcement in concrete support structures from corrosion comprising:

flexible panel means having first and second sides of which at least said first side comprises conductive polymer;

means for affixing said panel means about the circumference of a concrete support structure; and projections carried by said first side for providing conductive contact between said first side and a concrete support structure but preventing total contact therewith and which allow the free passage of water therebetween.

2. An anodic boot, as set forth in claim 1, wherein said projections carried by said first side form ribs with channel passageways therebetween.

3. An anodic boot, as set forth in claim 1, wherein said flexible panel means further includes a pair of opposed flanges projecting from said second side.

4. An anodic boot, as set forth in claim 3, wherein said means for affixing comprises an open channel having inwardly directed edges engageable with two of said flanges.

5. An anodic boot, as set forth in claim 3, wherein said panel comprises EPDM rubber.

6. An anodic boot, as set forth in claim 5, wherein said first side comprises silicone rubber containing a conductive material to impart a resistivity thereto of from about 0.5 to 10 ohm-cm and said second side comprises EPDM rubber, said first and second sides being joined by an adhesive.

7. An anodic boot, as set forth in claim 1, wherein said means for affixing comprises a rubber strip adhered to said second side of said panel means and encircling said panel means.

8. An anodic boot, as set forth in claim 7, wherein said panel comprises EPDM rubber.

9. An anodic boot, as set forth in claim 8, wherein said first side comprises silicone rubber containing a conductive material to impart a resistivity thereto of from about 0.5 to 10 ohm-cm and said second side comprises EPDM rubber, said first and second sides being joined by an adhesive.

10. An anodic boot, as set forth in claim 1, wherein said anodic boot further includes a fluoroelastomer coating.

* * * * *